US006130990A

United States Patent [19]

Herrick et al.

[11] Patent Number: 6,130,990

[45] Date of Patent: Oct. 10, 2000

[54] ON-DEMAND DIRECT ELECTRICAL RESISTANCE HEATING SYSTEM AND METHOD THEREOF

[75] Inventors: James Peter Herrick, Brookfield, Conn.; Sudhir Sastry, Dublin, Ohio; Gene Frank Clyde, New Milford; Elaine Regina Wedral, Sherman, both of Conn.

[73] Assignee: Nestec S.A., Vevey, Switzerland

[21] Appl. No.: 09/139,639

[22] Filed: Aug. 25, 1998

[51] Int. Cl.[7] ..... H05B 3/60

[52] U.S. Cl. ..... 392/321; 392/312; 392/318; 392/338

[58] Field of Search ..... 392/311–315, 319–24, 392/318, 338; 99/280, 287, 289 R, 295; 222/251, 412

[56] References Cited

U.S. PATENT DOCUMENTS

| | | | |
|---|---|---|---|
| 2,680,802 | 7/1954 | Bremer et al. | 392/321 |
| 2,748,253 | 5/1956 | Bremer | 392/318 |
| 3,218,175 | 11/1965 | Siegel et al. | 426/416 |
| 3,796,857 | 3/1974 | Henley et al. | 392/315 |
| 3,867,610 | 2/1975 | Quaintance | 392/318 |
| 3,925,638 | 12/1975 | Scatoloni | 392/320 |
| 3,983,359 | 9/1976 | Walker et al. | 219/284 |
| 4,015,749 | 4/1977 | Arzberger et al. | 222/640 |
| 4,417,132 | 11/1983 | Simpson | 219/291 |
| 4,730,098 | 3/1988 | Cave | 219/291 |
| 5,267,506 | 12/1993 | Cai | 99/280 |
| 5,583,960 | 12/1996 | Reznik | 392/321 |
| 5,607,613 | 3/1997 | Reznik | 219/771 |
| 5,630,360 | 5/1997 | Polny, Jr. | 99/451 |
| 5,652,006 | 7/1997 | Assinder et al. | 426/231 |

FOREIGN PATENT DOCUMENTS

| | | |
|---|---|---|
| 0 457 179 A1 | 11/1991 | European Pat. Off. . |
| 0 328 283 B1 | 10/1993 | European Pat. Off. . |
| 0 690 660 A1 | 1/1996 | European Pat. Off. . |
| 2 422 114 | 11/1979 | France . |
| 2 587 449 | 3/1987 | France . |
| 24 43 397 | 1/1976 | Germany . |
| 4015704 A1 | 5/1990 | Germany . |
| 3172161 | 7/1991 | Japan . |
| 6078692 | 3/1994 | Japan . |
| 7-39320 | 2/1995 | Japan . |
| 8-182470 | 7/1996 | Japan . |
| 2659313 | 6/1997 | Japan . |
| 92 00 429 | 3/1992 | Netherlands . |
| 572947A | 9/1977 | Russian Federation . |
| 1685377 | 10/1991 | Russian Federation . |
| 1792634 | 2/1993 | U.S.S.R. . |
| 2038543 | 6/1995 | U.S.S.R. . |
| 2 301 270 | 11/1996 | United Kingdom . |
| 2 304 263 | 3/1997 | United Kingdom . |
| WO 96/04804 | 2/1996 | WIPO . |
| 98/16477 | 4/1998 | WIPO . |
| 99/08482 | 2/1999 | WIPO . |

*Primary Examiner*—Teresa Walberg
*Assistant Examiner*—Thor Campbell
*Attorney, Agent, or Firm*—Pennie & Edmonds LLP

[57] ABSTRACT

A liquid heater includes an electrical power supplier and a heating passage configured to receive unheated liquid. The heating passage is defined by a first electrode and a second electrode. The first and second electrodes are electrically connected to the electrical power supplier. The unheated liquid received into the heating passage generates heat when an electric current flows through the liquid and between the first and second electrodes. The liquid heater is utilized in beverage product dispensers and heated liquid food product dispensers.

39 Claims, 4 Drawing Sheets

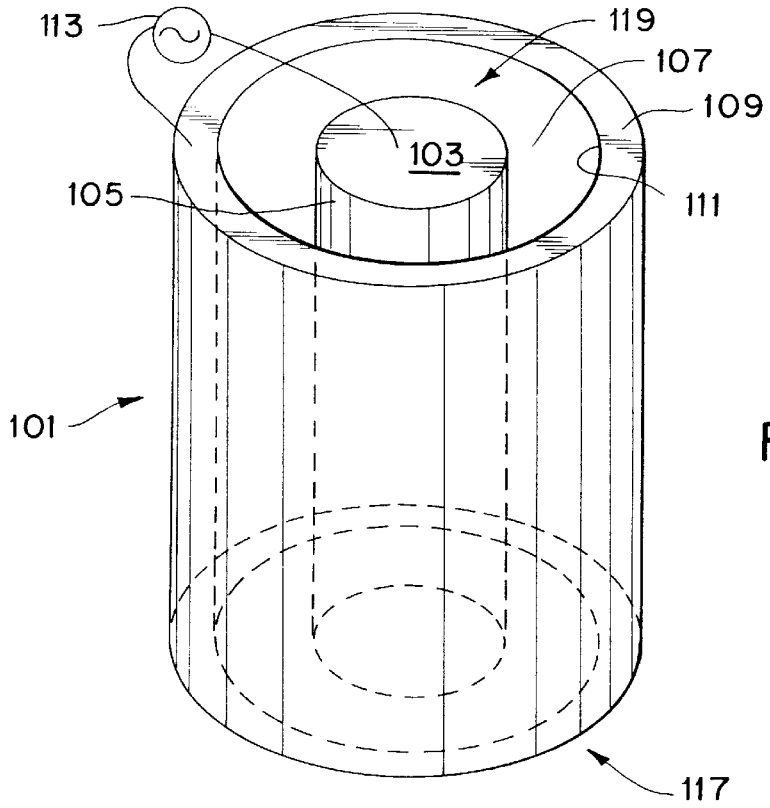
FIG. 1
FIG. 2
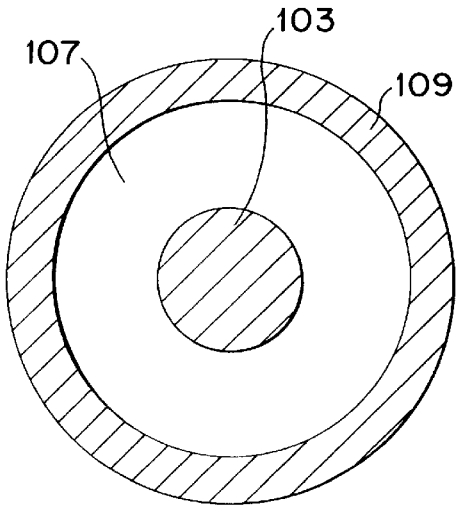
FIG. 3
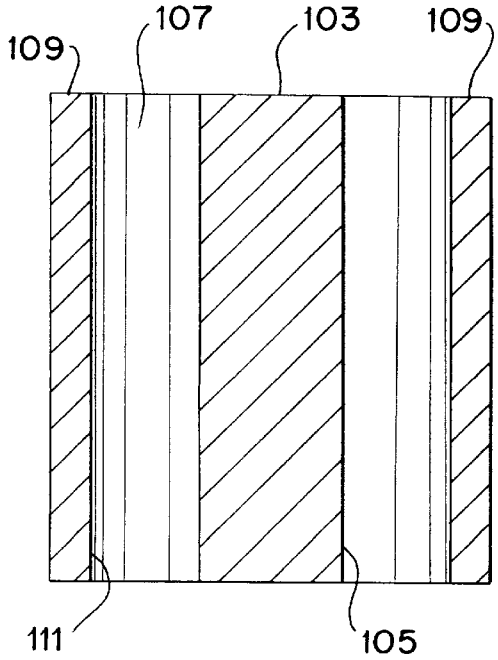

FIG. 8
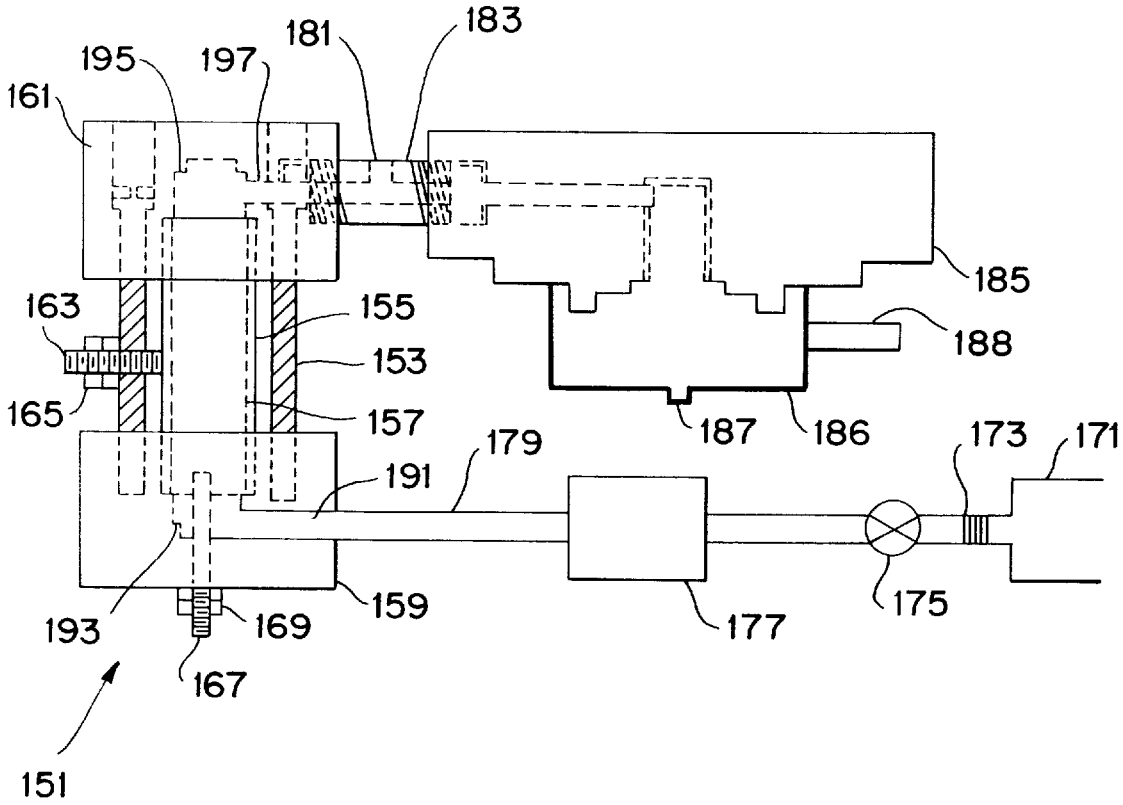
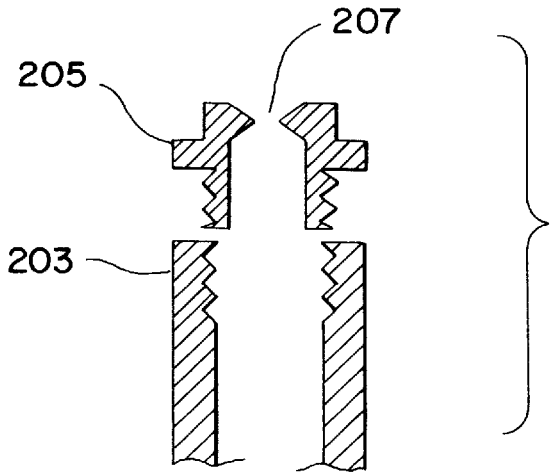
FIG. 9

ON-DEMAND DIRECT ELECTRICAL RESISTANCE HEATING SYSTEM AND METHOD THEREOF

FIELD OF THE INVENTION

The present invention relates to water heaters for brewing beverage products and for reconstituting food products by supplying heated water and, more specifically, relates to water heaters utilizing direct electrical resistance (DER) heating devices.

BACKGROUND OF THE INVENTION

Conventional beverage makers such as coffee brewing machines have water storage tanks, commonly made of stainless steel, to hold water and heating rods with which to heat the water in the water storage tanks. The heating rods include tubes packed with sand and heat generating filaments. Heat generated by the filament is transferred to the sand and, then, to the water in the water tank, thereby heating the water.

Other conventional beverage makers include water boilers similar to the hot water storage tanks except that these boilers are held under pressure enabling the water to be heated to a higher temperature.

Theses conventional beverage makers, however, suffer from a number of drawbacks. For instance, they require a lengthy cold start period during which a cold water tank, or a boiler, filled with unheated water is heated. They also require a long recovery time when heated water is dispensed and, then, replenished with unheated water. In addition, the water quality tends to degrade over time when kept at a high temperature for prolonged periods of time.

In an effort to alleviate the above drawbacks, some of the conventional coffee brewing machines include on-demand water heating devices. These conventional on-demand water heating devices heat water only when requested. Conventional on-demand heating devices that produce small quantities of heated water include indirect electrical resistance heaters which are bonded to a water pipe. On the other hand, conventional on-demand heating devices that produce larger quantities of heated water include heating blocks which contain a coiled water tube and a coiled heating rod encased in a block of metal. The heating block is a thermal energy storage device to heat water on-demand as unheated water passes through the heating block. This requires a constant supply of electrical power to the heating block in order to maintain it at a certain temperature, thereby wasting electrical energy and losing thermal energy to its environment. In general, the conventional on-demand water heaters are inefficient, among other reasons, because they utilize the indirect resistance heating method.

The conventional heating devices discussed above are prone to fail prematurely due to calcification. According to a lab test performed on the conventional on-demand heating devices, the devices failed after about 5500 cycles due to excessive calcification. In addition, the conventional heating devices, due to the drawbacks outlined above, cannot produce heated water at a stable temperature which is a desirable feature in brewing some high quality beverages.

Instead of the conventional water heating method described above, direct electrical resistance (DER) heating methods have been developed for industrial uses. The DER method is also known as electroheating, in-line heating or ohmic heating. A conventional DER device includes a pair of electrodes and an electric power supplier for applying a high power, high frequency electricity to the electrodes. As an electrically conductive medium, such as meat or other food products, passes between the electrodes, electric currents flow through the medium which generate heat therein. The medium generates heat since it acts as a resistor.

Several references disclose the DER methods for heating different types of electrically conductive medium. For instance, U.K. Patent Application No. GB-A-2304263 (the "'263 application") discloses an electroheating, processing, pasteurizing and cooking liquid egg. In this electroheating method, liquid egg is pasteurized when it passes through a pair of electrodes while electric power is applied between the electrodes. This method, however, heats only one type of electrically conductive medium, the liquid egg, in a controlled production line. In addition, this method, as with other conventional DER heating methods, requires a high power, high frequency electrical power supplier which tends to be relatively expensive for non-industrial use.

SUMMERY OF THE INVENTION

Accordingly, the water heater of the present invention utilizes a DER heating device without the drawbacks of the conventional DER heating devices described above.

First of all, the DER heating devices of the present invention draws its electrical power from electrical power outlets commonly supplied to homes, offices, restaurants or food servicing facilities. Second, the DER heating device of the present invention is adaptable to varying conductivity of different types of water. Third, electrodes of the DER heating device of the present invention are made of inert, rigid, electrically conductive material tolerant of wear and graded for food processing.

In addition, since the heating device of the present invention utilizes a DER heating device, it is capable of rapid and efficient transfer of the electrical energy into the water as thermal energy while reducing the energy loss associated with the indirect heating methods of the conventional beverage makers discussed above.

The present invention also provides beverage product dispensers for use in homes, offices, restaurants and food service facilities using DER devices to heat water to make beverage products such as espresso, coffee, hot chocolate, and tea. The beverage product dispenser of the present invention brews the beverage products under desired extraction condition, which may include the temperature of the heated water and the pressure under which the beverage products are brewed, in order to make consistently high quality beverage products.

The beverage dispenser of the present invention may include a water pipe and a water source connector to supply water to a heating unit. The heating unit includes an inner and outer electrode forming a heating passage. The water supplied to the heating passage generates heat when an electric current flows through the water and between the electrodes. The heating unit is surrounded by an insulating tube and fluid sealed by an inlet sealant and an outlet sealant. The heated water is released to a dispensing head. The dispensing head releases the heated water to a brewing chamber in which the heated water is mixed with grounded beverage substance to produce beverage products.

The beverage dispenser also includes a controller which regulates the amount of water supplied to the heating unit and the amount of electrical current supplied to the electrodes to ensure that the heated water at the dispensing head reaches an optimal water temperature.

In addition, the present invention provides liquid food product dispensers for use in homes, offices, restaurants and food service facilities using DER devices to heat water to reconstitute dried food products or to mix hot water to concentrated food products.

BRIEF DESCRIPTION OF THE DRAWINGS

FIG. 1 is a perspective view of a heating unit;

FIG. 2 is a top cross-sectional view of the heating unit;

FIG. 3 is a side cross-sectional view of the heating unit;

FIG. 8 is a system block diagram of a beverage dispenser;

FIG. 9 is a side cross-sectional view of the heating unit with a cap having a conical annular opening;

DETAILED DESCRIPTION OF THE INVENTION

Figure 4:
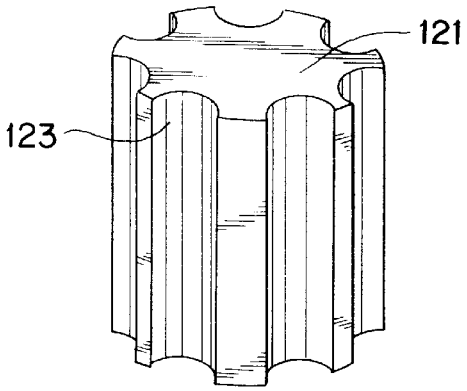
FIG. 4 is a perspective view of an inner electrode with semi-circular grooves.

The device of the invention is illustrated in FIGS. 1–3. This device has a heating unit 101, which includes an inner electrode 103, an outer electrode 109 and a heating passage 107 defined by a gap between the electrodes 103, 109. Each of the inner and outer electrodes 103, 109 has electrically conducting surfaces 105, 111, respectively. The heating unit has an inlet side 117, which receives liquid, and an outlet side 119, which releases the liquid. The heating unit receives electrical power from an electrical power supplier 113.

The liquid to be heated by the heating unit 101 is, preferably, water. In alternative embodiments, however, any liquid capable of conducting electricity, which includes soups, food products and sauces, is heated by the heating unit 101. Hereinafter, water will represent the liquid.

In operation of the heating unit 101, electricity is applied between the inner and outer electrodes 103, 109, and, then, currents flow between the electrodes through water when the water is supplied to the heating passage 107. The water acts as a resistor by inhibiting the flow of the electrical current. This resistance, in turn, causes the water to generate heat. Hence, as the water flows from the inlet side 117 to the outlet side 119 of the heating passage 107, the temperature of the water is raised, up to 300° F., in the heating passage 107.

In one preferred embodiment, requiring a low water flow rate, 150–250 ml per minute, the gap between the inner and outer electrode 103, 109 is on the range of 0.0625–0.500 inches for a heating passage having a length between 2–3 inches. In another preferred embodiment, requiring a water flow rate between 160–200 ml per minute, the gap between the inner and outer electrode 103, 109 is on the range of 0.078–0.118 inches for a heating passage having a length between 2.5–3.5 inches. In yet another preferred embodiment, requiring a higher flow rate, 0.2–0.3 gallons per minute, the gap between the electrodes is on the range of 0.25–0.35 inches for the heating passage having a length between 10–14 inches. The preceding embodiments, especially embodiments with narrow gaps, allow the unheated water to be heated with a minimal initial waiting period and to a consistent temperature. The initial waiting period is reduced since the water volume in the narrow gap is small. The consistent temperature of the heated water is possible since, again, the volume within the heating passage is small, the water temperature may readily be monitored and controlled.

The heating unit in the above embodiments are capable of receiving water at 70° F. or colder and heating it, preferably, up to 200° F. and, alternatively, up to 300° F. In one preferred embodiment, the water temperature is raised to be between 187° F.–196° F. In addition, a heating unit capable of water flow rate up to 2 or 3 gallons per minute is contemplated within this invention. As illustrated with these embodiments, the gap size and the length of the heating passage vary with the required water flow rate along with other factors such as the conductivity of the water and the temperature difference between the heated and unheated water.

In one alternative embodiment, steam is produced by combining the heating unit 101 with a hot water bypass line coupled to the outlet side 119 of the heating passage 107. The hot water bypass line, which includes a reduced size orifice to increase the water pressure passing therein, in combination with sufficiently high water temperature, produces the steam. In one exemplary embodiment, as in steam wands in espresso machines, the hot water bypass line is provided near or at its point of use. In another embodiment, the hot water bypass line is provided near the heating unit 101, even though this configuration precipitates minerals which may cause the hot water bypass line to be clogged after many repeated uses.

The electrodes 103, 109 are preferably made of graphite, however, any inert, rigid, electrically conductive material tolerant of wear and graded for food processing can be made into the electrodes of the present invention. In an alternative embodiment, any suitable material, even non-conductive material can be either coated or plated with a conductive material, suitable for the application, and utilized to form the electrodes. For instance, in an exemplary embodiment, a ceramic material plated with inert, electrically conducting and precious metal, such as platinum, is utilized to form the electrodes 103,109.

The inner electrode 103 is preferably a rod, and the outer electrode 109 is a cylinder with which to surround the inner electrode 103. In one alternative embodiment, the inner electrode has a hollow core. Electrodes in any other shape, such as square, rectangular, triangular or oval, are sufficient for the present invention as long as the inner and outer electrodes form a heating passage.

In one preferred embodiment, the water in the heating passage makes direct physical and electrical contact with the electrodes, thereby increasing the efficiency with which the water is heated.

Due to the flow of the electrical currents, the electrodes can be subjected to erosion. The erosion on the electrodes is proportional to corresponding current density of electric current. In other words, an electrode subject to higher current density erodes faster than an identical electrode subject to less current density.

The inner electrode 103 is subject to a higher current density compared to the outer electrode 109 since the inner electrode has a smaller conducting surface than that of the outer electrode. This causes disproportional erosion on the inner electrode 103.

Figure 5:
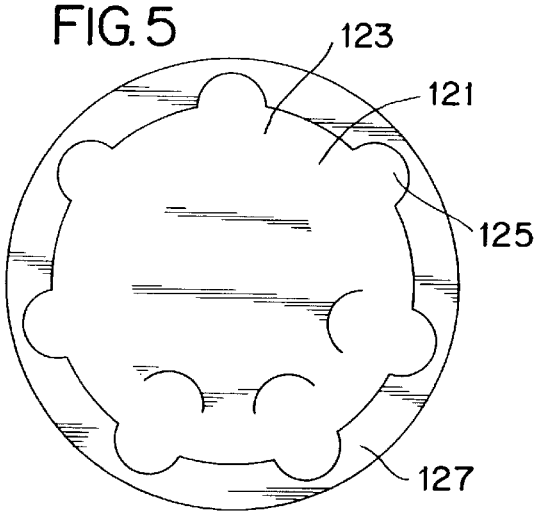
FIG. 5 is a top cross-sectional view of an inner electrode and an outer electrode with semi-curricular grooves.

This problem of disproportional erosion is ameliorated when the surface area of the inner electrode 103 is increased. In one embodiment, depicted in FIG. 4, the surface area of an inner electrode is 121 increased by providing a pattern 123 on its surface. The pattern is preferably a plurality of arcuate grooves 123 that are cut longitudinally into the inner electrode 121. The size and the shape of the grooves are determined to minimize the disproportional erosion on the electrically conductive surfaces of the inner and outer electrodes. Any pattern, such as rectangular, triangular, oval or semi-circular, that increases the surface area of the inner electrode is sufficient for the present invention. In yet another embodiment, an outer electrode 127 also has a pattern that matches the pattern formed into the inner electrode, as illustrated in FIG. 5, in order to increase the surface area of the outer electrode 127.

In addition, referring back to FIG. 1, the outlet side 19 of the electrodes are subjected to a higher rate of erosion compare to that of the inlet side. This is caused by changing water conductivity. As the water temperature increases, its conductivity increases allowing more electrical currents to flow at the outlet side 119 of the electrodes, thereby subjecting the outlet side of electrodes to a higher current density than that of the inlet side.

Figure 6:
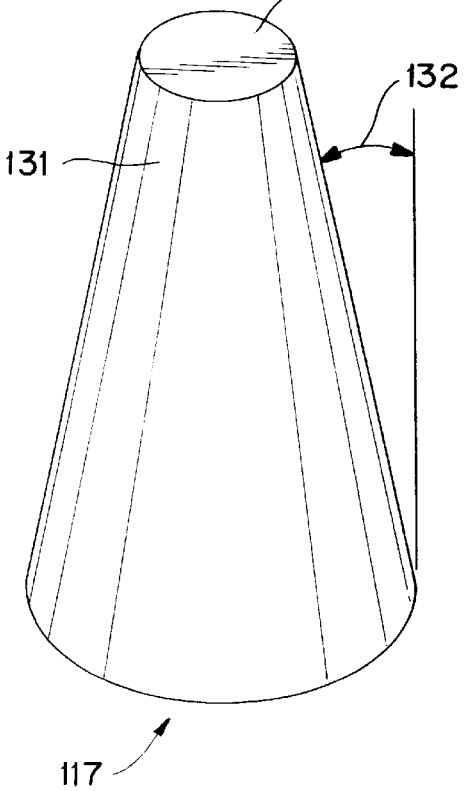
FIG. 6 is a perspective view of a conical inner electrode.

In order to reduce this imbalance of current densities, in one preferred embodiment, a conical inner electrode 131 is provided as depicted in FIG. 6. When the conical inner electrode 131 is combined with the cylindrically shaped outer electrode 109, the gap at the inlet side 117 of the electrode is narrower than that of its outlet side 119. In an exemplary embodiment, the angle 132 formed by the thickness difference between the inlet and outlet sides of the inner electrode 131 is on the range of 1°–2°; however, steeper angles are also contemplated within this invention.

Hence, at the inlet side, where the water is cold and has lower electric conductivity, the gap between the electrode is narrower than that of the outlet side where the water is heated and has higher electric conductivity. This geometry of electrodes allows the substantially same amount of current to flow at the inlet and outlet sides of the electrodes. In this preferred embodiment, any combination of differently shaped inner and outer electrodes is adequate for the present invention as long as the combination reduces the imbalance in the erosion of the electrodes.

If other liquids having the conductivity and the temperature relationship reverse to that of water are used, then the geometry of the electrodes should be reversed. In other words, if a liquid exhibits lower electrical conductivity as its temperatures rises, then a heating unit to heat such a liquid will have a reversed conical inner electrode to balance the current densities at its inlet and outlet side of its electrodes.

In one preferred embodiment, the heating unit 101 is utilized in food processing appliances such as hot beverage dispensers or hot food product dispensers for both home and food service uses. The food service in this context includes coffee shops, restaurants and cafeterias in offices and schools.

Exemplary hot beverage dispensers, which utilize the heating unit 101, include the following: coffee brewer and coffee dispensers which use soluble coffee or tea; tea brewers and dispensers; and other beverage dispensing appliances for supplying heated water to liquid concentrates, beverage dried powders or tablets, filter pouched coffee or teas for extraction, or beverage products where the package functions as the brewing and mixing chamber.

Exemplary appliances for hot food product dispensers, utilizing the heating unit 101, include any food processing appliances requiring the use of hot water in its preparation (e.g., dried soups, liquid food concentrates, dried food powders or tablets, and food products packaged for handling and delivering).

The above exemplary appliances can be part of food service office beverage systems, food service vending machines, food service restaurant or banquet beverage systems, food service hot water supply systems, home water supply systems, and home beverage equipments (coffee makers and tea makers).

One preferred embodiment of a beverage dispenser 151 of the present invention, including a heating unit having a rod shaped inner electrode 157 and a cylindrical outer electrode 155, is illustrated in FIG. 8. In alternative embodiments, the heating unit is any of the heating unit embodiments disclosed above. The heating unit is surrounded by an insulating tube 153. The electrodes 155, 157 and insulating tube 153 are firmly fixed and fluid sealed by an inlet sealant 159 and an outlet sealant 161. The inlet sealant 159 receives water from an inlet pipe 179 connected to a water supply regulator 177 and a water source connector 173. The water source connector 173 is connected to a water supply source 171. The outlet sealant 161 is in fluid communication with a dispensing head 185. A transition tube 183 is optionally provided between the outlet sealant 161 and the dispensing head 185.

The water supply source 171 is, preferably, a municipal water pipe. However, any other source such as bottled water or well water is adequate for the present invention. The connector 173, adapted to receive water from the water supply source, is, preferably, a water pipe connector. In an alternative embodiment, the connector 173 includes a sediment or treatment cartridge to filter particles and/or for treating the water. The treatment may for example be mineralization of the water to increase conductivity.

A conventional valve 175, configured to turn on or to shut off the water supplied to the pump, is optionally provided. The water supply regulator 177 is either a pump or a pressure regulator to deliver water to the heating unit. The pump is capable of delivering a water pressure up to 20 bar, and is, preferably, a CP3 or CP4 manufactured by Eaton Products. The pressure regulator is a conventional pressure regulator to adjust the water pressure in the pipe.

The water entering through the inlet sealant 159 passes through a heating passage formed by a gap between the inner and outer electrodes 157, 155. As the water passes through the heating passage, the water generates heat as described above. The heated water, then, exits the heating passage through the outlet sealant 161 to the transition tube 181. The heated water is, then, flows to the dispensing head 185.

The structure disclosed above is less susceptible to failures due to calcification. According to one laboratory experiment, the above beverage dispenser withstood 13,000 repeated uses without failing due to excessive calcification.

The inlet and outlet sealants 159, 161, the transition tube 183, the dispensing head 185 and the insulating tube 153 are molded substantially from ULTEM™ polyetherimide of GE Plastics, is a rigid, dielectric material which is also thermally non-conductive, graded for food processing and capable of withstanding high water pressure, e.g., 20 bars. Therefore, insubstantial electric current is leaked through the sealants and the transition tube, and the water temperature is preserved. In alternative embodiments, ERTALYTE® PET-P, a semi-crystalline thermoplastic polyester based on polyethylene terephthalate manufactured from resin grades made by DSM Engineering Plastic Products, or PEEK™ polymer, is utilized. However, any rigid, moldable and dielectric material thermally non-conductive and graded for food processing is adequate for the present invention.

Each of the inlet and outlet sealants 159, 161 has an opening to receive or release water 191, 197, respectively, and a plurality of concentric annular steps 193, 195 with which to receive portions of the inner and outer electrodes. In an alternative embodiment, any sealant having an opening to receive or release water and providing electrical and fluid seal among the inner and outer electrodes 155, 157 and the insulating tube 153 is adequate for the present invention.

The insulating tube has an opening to receive an electrical connection 163 to the outer electrode 155. The inlet sealant 159 has another opening to receive an electrical connection 167 to the inner electrode 157. In alternative embodiments, the electrical connections to the electrodes are provided through the inlet or the outlet sealants.

In one preferred embodiment, the heating unit is thermally and electrically insulated by the insulating tube and the inlet and outlet sealants. The thermal insulation increases the overall energy efficiency of the heating unit by keeping the thermal energy from escaping to its environment.

As discussed above, the heated water flows to the dispensing head. In one embodiment, a beverage brewing chamber 186, arranged to form a fluid seal with the dispensing head to withstand up to 15–20 bars of pressure and attached to a handle 188, is provided. A predetermined amount of beverage making substance packaged in a capsule or placed on a filter is provided inside the beverage brewing chamber before the brewing chamber forms the fluid seal with the dispensing head. (In the embodiment the capsules are provide, a pin to puncher the capsules is disposed on the dispensing head.) The heated water dispensed from the dispensing head and the beverage making substance are mixed under pressure and, then, the brewed product is dispensed from the bottom of the brewing chamber to a cup. In an alternative embodiment, an orifice 187 is provided to the brewing chamber in order to produce steam.

In one preferred embodiment, the beverage substance, to be extracted under pressure, is sealed in a cartridge (or capsule) which is provided into a cartridge holder, which is similar to the brewing chamber. The heated water from the dispensing head and air are injected under pressure between 1 to 20 bars and, more preferably, 15–20 bars into the cartridge which includes an extraction face. This pressure is exerted to the extraction face of the cartridge against a relief surface, which includes relief and recessed elements, of the cartridge holder. After a sufficient injection of the heated water and the air into the cartridge, the extraction face is torn apart at the locations of the relief elements or recesses. Subsequently, the beverage product, brewed under pressure in the cartridge, is released from the cartridge and dispensed to a cup located there below. This embodiment allows the beverage product to be extracted under pressure between 1 to 20 bars and, more preferably, 15–20 bars.

In another embodiment, a conventional coffee filter holding the beverage making substance is attached to the dispensing head. In yet another embodiment, the dispensing head dispenses the heated water directly into a cup, which has beverage making substance placed therein, located below the dispensing head.

The beverage making substance includes grounded coffee beans, grounded tea leaves, liquid beverage concentrates, other similar grounded, powdered or tablet beverage products.

The dispensing head also includes a ground electrode, not shown in FIG. 8, disposed such that it touches the heated water supplied from the heating unit. This feature electrically grounds any leakage current flowing from the electrodes through the heated water to the dispensing head. In an alternative embodiment, the water supplied from the heating unit may be physically separated by addition of a container which receives the water in a chamber which opens and closes to allow pockets of water to drop into a second chamber which opens and closes to allow electrically neutral water to be dispensed. In another alternative embodiment, in order to dispense electrically neutral water, an in-line rotary star type valve or any other device can be used as long as it separates the hot water from the DER heater, which may carry some electricity, from the hot water being used for reconstitution or being dispensed or to insure the finished beverage being dispensed is electrically neutral. In yet another alternative embodiment, electrically neutral heated water is obtained by allowing water from the heater to fill an intermediate container holding a desired amount of water for dispensing at which point, once filled, the power of heating unit is shut off and the heated water is dispensed.

FIG. 9 illustrates another preferred embodiment of an outlet sealant which includes a threaded cap 205 having a conical annular outlet 207. The conical annular outlet 207 forces the water flowing through it to speed up and pick up particles and impurities which otherwise may clog up the outlet.

Referring back to FIG. 8, the transition tube 183 optionally includes an opening 181 to receive a temperature sensor. In an alternative embodiment, the temperature sensor is located in the heating unit. Regardless where the temperature sensor is located, it senses the temperature of the heated water.

A controller is used to regulate the operations of the beverage dispenser to produce the heated water at the desired temperature based on operator entered selections, fixed and adjustable variables and feedback data.

The operator entered selections include the desired temperature of the heated water or the desired fluid pressure at which the heated water exits the dispensing head. For the selections, the beverage dispenser is provided with a plurality of switches, accessible by the operator. Each switch allows the operator to set the temperature range or the water pressure range at which the heated water is to be delivered to the beverage ground holder. In alternative embodiments, the temperature range and the water pressure range are preset when the dispensers are manufactured.

The fixed variables include the conductivity of the water, the gap between the electrodes, the length of the electrodes.

The conductivity of water varies from one water source to another. Water from one source may contain impurities and particles causing the water to have a high conductivity, and distilled water may not contain any impurity causing low conductivity. The conductivity of the water is either assumed to be at a certain range or an operator selects approximate value. In one preferred embodiment, the conductivity of the water is calculated. This calculation is achieved by the following steps: (1) applying a small but known electric voltage between the electrodes; (2) measuring the amount of the current flowing through the water; (3) calculating, using the Ohm's law, the resistance value of the water; and (4) calculating the conductivity of the water based on the resistance value since the conductivity is inversely proportional to the resistance.

The adjustable variables include the amount of electrical current applied to the electrodes and the amount of water supplied to the heating unit by the water supply regulator.

The feedback data include the temperature reading of the heated water measured by the temperature sensor.

The controller is configured to receive all the relevant information which includes the operator entered selections, the fixed variables, and feedback data. Based on the received information, the controller then regulates the adjustable variables. The controller also includes sufficient memory and processing power to process the received information and to send appropriate signals for regulating the adjustable variables.

Figure 10:
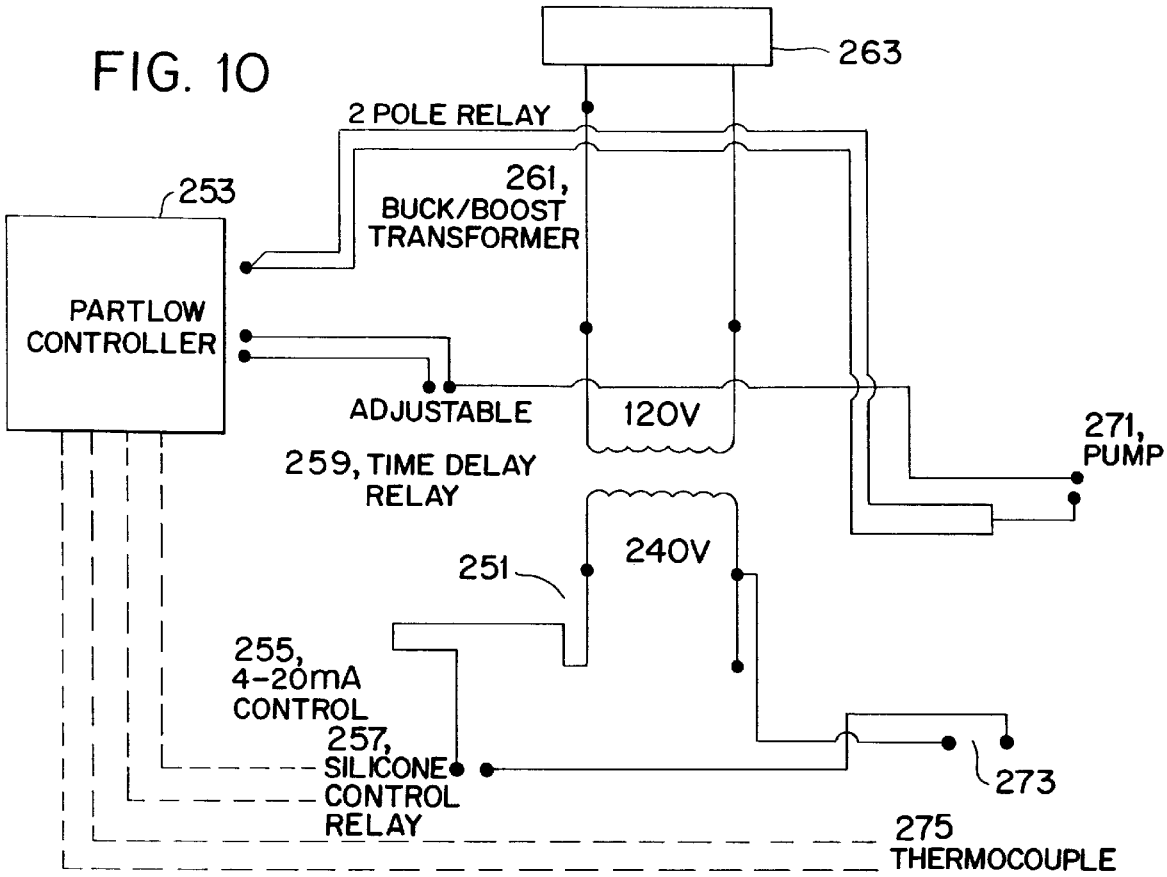
FIG. 10 is a circuit diagram of a controller.

One preferred embodiment of the controller implemented with a microcontroller is illustrated in FIG. 10. The microcontroller 253, preferably, is a MIC 2000 controller manufactured by Partlow. The MIC 2000 controller is a microprocessor based single loop process controller. It controls a variety of processes including those requiring dual 4–20 mA output with full PID (Proportional, Integral and Derivative controls). In alternative embodiments, the controller is a microprocessor, an ASIC chip, a computer, electronic logic chips or any combination of them.

The controller also includes connections to an electrical power supplier 251, which includes an optional power transformer 261 and an electric power rectifier 257 controlled by 4–20 mA control signal from the MIC 2000 controller. The electric power rectifier 257 is, preferably, a silicon control relay (SCR) rectifier. The controller also includes connections to an adjustable time delay relay 259 and receives feedback data from a thermocouple 275 which is connected to the temperature sensor.

The power supplier 251 receives its electric power from a wall outlet, commonly furnished in homes, offices, stores and restaurants, which provides 120 V–460 V alternating electric power with its frequency between 50–60 Hz and with 10–60 Amp. The preceding electric power supplies are sufficient for the heating unit of the current invention because of its thermal and electrical efficiency discussed above. The power supplier also includes a ground fault interrupter 263 which acts as a fuse.

The controller, using the features recited above, prestored data and programs, and feedback data, regulates the current applied across the electrodes 273 and the water supply regulator 271.

The time delay relay 259 is utilized when the dispenser is to be operated after a long pause. After each used of the dispenser, the heating unit retains water in its heating passage. If the dispenser is not continuously used, then it causes the retained water to cool down, thereby necessitating a cold start period. In this cold start period, actuating the water supply regulator is delayed so that sufficient time is provided to raise the temperature of the water retained in the heating passage.

Figure 7:
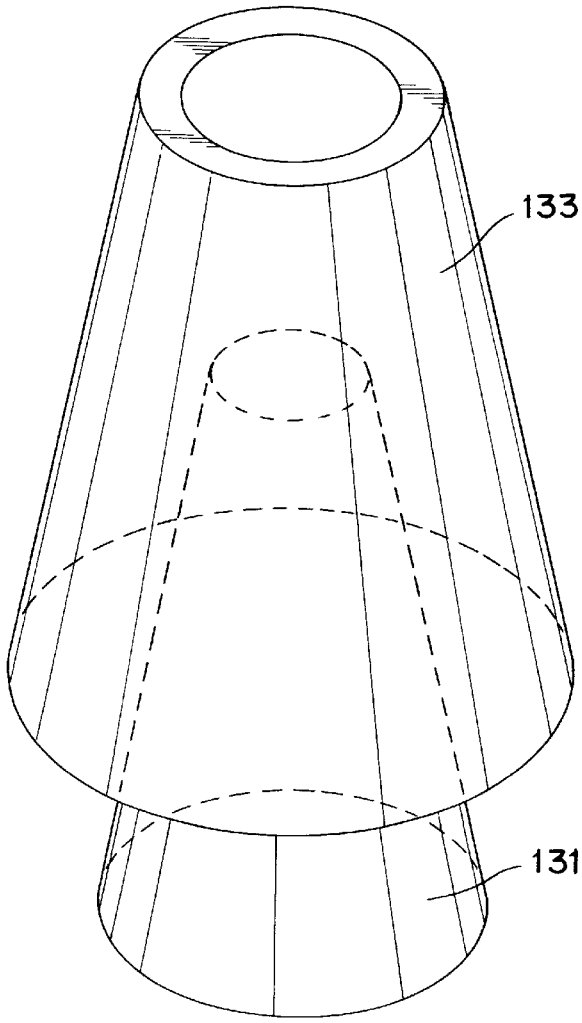
FIG. 7 is a perspective view of a conical inner electrode and a conical outer electrode.

Now referring to FIG. 7, in order to provide more adaptable control, a heating unit with an adjustable gap between the electrodes is provided. In this embodiment, a conical inner electrode 131 and a conical outer electrode 133 are provided, and the position of one of the electrodes is adjusted. As one of the electrodes moves close to the other electrode, the gap between the electrodes decreases, and vice versa. In another embodiment, the positions of the both electrodes are adjusted.

A shifter is provided to adjust the positions of the electrodes. In one preferred embodiment, the shifter is a threaded rod one end of which is connected to the bottom of inner electrode 131 and the other end of which is protruding from the heating unit, thereby allowing an operator to adjust the position of the inner electrode. In other embodiments, a motor controlled by the controller and connected to the one of the electrodes adjusts the position of the electrodes.

A heated liquid food product dispenser, with similar structures as that of the beverage dispenser discussed above, reconstitutes food products, such as dried soups, liquid food concentrates, dried food powders and the like, with heated water. The liquid food dispenser includes a mixing chamber instead of the brewing chamber of the beverage dispenser described above.

Figure 11:
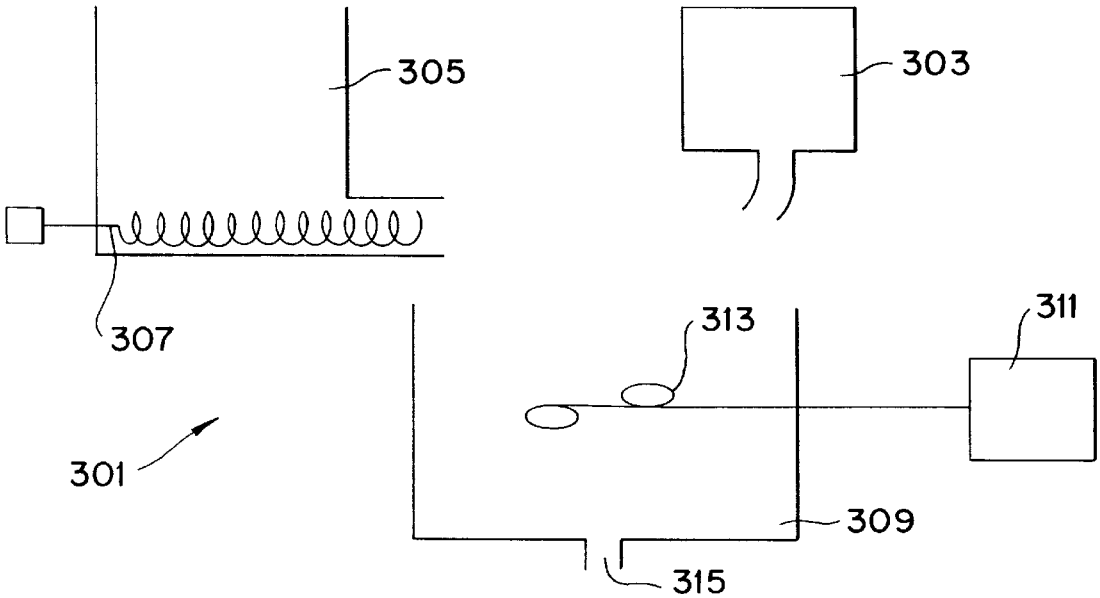
FIG. 11 is a portion of a reconstituted beverage or food product dispenser.

One preferred embodiment of the heated liquid food product dispenser, a portion of which is illustrated in FIG. 11, includes a heating unit 303, a hopper 305, a auger screw 307, and a mixing chamber 309. The heating unit 303 is any one of the heating unit embodiments discussed above.

The heating unit 303 is any one of the DER heating unit discussed above to heat water to a predetermined temperature, which is, preferably, up to 200° F. In another embodiment, the predetermined temperature is up to 300° F.

The hopper 305 is configured to hold dried food products. The auger screw 307 is connected to the hopper 305 and configured to dispense a certain amount of the dried food to the mixing chamber. The amount of disposed dried food is proportional to the length of time the auger screw 307 is activated. In an exemplary embodiment, when the auger screw 307 is activated for 3 seconds, it dispenses 2 grams of the dried food product.

The mixing chamber 309, preferably, fluidly sealed with the heating unit, receives heated water from the heating unit 303 and the dried food products from the auger screw 307, mixes the water and dried food product, and dispenses the reconstituted food products.

In one preferred embodiment, the mixing chamber 309 is static. In other words, the mixing is achieved by the heated water, which is supplied at a high pressure to the mixing chamber in this embodiment, causes the water and the dried food to swirl around, thereby mixing the water and the dried food. In another preferred embodiment, the mixing chamber includes an agitator which includes a motor 311 driving an impeller 313 in order create a swirl in the mixing chamber.

In an alternative embodiment of the heated liquid food product dispenser described above, instead of the dried food product, concentrated food products are provided. In this alternative embodiment, the hopper and the auger screw are replaced by a concentrate food product dispenser that dispenses a predetermined amount for the concentrate food product into the mixing chamber.

In an alternative embodiment of the beverage dispensers and the heated liquid food product dispenser discussed above, the beverage making substance or the food products may be supplied to the DER heating passage along with unheated water. In this embodiment, the DER heating device heats the water and the beverage making substance or the food products simultaneously. In addition, a filter is, optionally, provided at the dispensing head.

Although the preferred embodiments of the invention have been described in the foregoing description, it will be understood that the present invention is not limited to a water heating mechanism in a coffee brewer. For instance, the DER can be utilized in any application where heating other types of liquid is required. It should be understood that the materials used and the mechanical detail maybe slightly different or modified from the description herein without departing from the methods and composition disclosed and taught by the present invention as recited in the claims.

What is claimed is:

1. A liquid heater comprising:

a first electrode having an electrically conducting surface;

a second electrode having an electrically conducting surface disposed spaced apart from the first electrode;

a heating passage defined by the first and the second electrodes, the heating passage including:

an inlet opening configured to receive liquid into the heating passage; and an electrical power supplier configured to supply an AC electrical current to the first and second electrodes;

a current meter coupled to the heating passage and configured to measure the electrical current flowing between the electrodes; and a controller configured to calculate conductivity of the liquid based on the measured electrical current and to adjust the electrical current supplied to the electrodes based on, in part, the calculated conductivity;

wherein the first and second electrodes are arranged to make electrical contacts with liquid received into the heating passage, and the liquid in the heating passage generates heat when an electric current flows through the liquid and between the first and second electrodes.

2. The liquid heater of claim 1, which further comprises:

a dispensing head coupled to the heating passage and configured to receive and dispense the heated liquid from the heating passage.

3. The liquid heater of claim 2, which further comprises:

a chamber arranged to form a fluid seal with the dispensing head and to received the heated liquid from the dispensing head.

4. The liquid heater of claim 3, wherein the chamber is a brewing chamber arranged to hold beverage making substance to be mixed with the heated liquid.

5. The liquid heater of claim 1, which further comprises:

a liquid supply regulator configured to supply the liquid to the heating passage; and the controller configured to regulate the liquid supply regulator such that a predetermined amount of liquid is supplied to the heating passage.

6. The liquid heater of claim 5, further comprising:

a delay device configured to delay actuating the liquid supply regulator in a cold start stage in which previously supplied unheated liquid is present in the heating passage.

7. The liquid heater of claim 1, wherein the second electrode having a rod shape is disposed within the first electrode having a cylindrical shape.

8. The liquid heater of claim 1, wherein the second electrode having a conical shape is disposed within the first electrode having a hollow conical shape.

9. The liquid heater of claim 8, which further comprises:

an electrode shifter configured to move one of the first and second electrode in order to adjust the distance therebetween.

10. The liquid heater of claim 1, wherein the second electrode has a pattern on its electrically conducting surface.

11. The liquid heater of claim 10, wherein the pattern includes a plurality of arcuate grooves.

12. The liquid heater of claim 1, wherein the first and second electrodes are made of graphite.

13. The liquid heater of claim 1, which further comprises:

a first sealant having an opening to receive the liquid; and a second sealant having an outlet, wherein the heating passage is fluid sealed by the first and second sealants.

14. The liquid heater of claim 13, wherein the outlet is defined by a conical annular opening.

15. The liquid heater of claim 1, which further comprises:

a transition tube coupled to the heating passage and the dispensing head, the transition tube configured to transfer the heated liquid from the heating passage to the dispensing head.

16. The liquid heater of claim 1, which further comprises:

a temperature sensor configured to sense the temperature of the heated liquid; and the controller configured to regulate the amount of electrical power supplied to the heating passage based on the sensed temperature.

17. The liquid heater of claim 1, which further comprises:

a hot liquid bypass line, configured to generate steam, being coupled to the heating passage.

18. The liquid heater of claim 1, wherein the liquid is water.

19. A method of producing heated beverage products, the method comprising the steps of:

supplying unheated liquid into a heating passage formed between a first electrode and a second electrode;

passing the liquid through the heating passage;

measuring conductivity of the liquid;

supplying a sufficient amount of electrical current between the first and second electrodes based on, in part, the measured conductivity of the liquid, to thereby heat the liquid to a predetermined temperature; and dispensing the heated liquid, to thereby produce heated beverage products.

20. The method of claim 19, the dispensing step further comprising the step of:

supplying the heated liquid into a capsule containing beverage making substance.

21. The method of claim 19, the dispensing step further comprising the steps of:

supplying beverage making substance to a cup; and supplying the heated liquid to the cup, thereby producing an instant beverage product.

22. The method of claim 19, the dispensing step further comprising the step of:

mixing the heated liquid and a beverage making substance, to thereby produce a heated beverage product, and dispensing said heated beverage product.

23. The method of claim 19, further comprising the step of:

generating steam for producing beverage products that require steam.

24. The method of claim 19, wherein the liquid is water.

25. A beverage product dispenser comprising:

a first electrode having an electrically conducting surface;

a second electrode having an electrically conducting surface disposed spaced apart from the first electrode;

a heating passage defined by the first and the second electrodes, the heating passage including:

an inlet opening configured to receive liquid into the heating passage;

an electrical power supplier configured to supply an electrical current to the first and the second electrodes, wherein the first and second electrodes arranged to make electrical contacts with liquid received into the heating passage, and the liquid in the heating passage generates heat when an electric current flows through the liquid and between the first and second electrodes;

a current meter coupled to the heating passage and configured to measure the electrical current flowing between the electrodes; and a controller configured to calculate conductivity of the liquid based on the measured electrical current and to adjust the electrical current supplied to the electrodes based on, in part, the calculated conductivity; and a dispensing head configured to receive the heated liquid from the heating passage and arranged to dispense the heated liquid for producing beverage products.

26. The dispenser of claim 25, which further comprises:

a brewing chamber fluidly sealed with the dispensing head to receive the heated liquid therefrom, and the brewing chamber configured to mix the heated liquid and beverage making substance.

27. The dispenser of claim 26, wherein the brewing chamber further comprises an orifice configured to dispense the beverage products.

28. The dispenser of claim 26, wherein the brewing chamber is configured to receive a cartridge, which is arranged to brew the beverage product therein, containing beverage making substance.

29. The dispenser of claim 25, wherein the liquid is water.

30. A method of dispensing heated liquid food products, the method comprising the steps of:

supplying unheated liquid into a heating passage formed between a first electrode and a second electrode;

passing the liquid through the heating passage;

measuring conductivity of the liquid;

supplying a sufficient amount of electrical current between the first and second electrodes based on, in part, the measured conductivity of the liquid, to thereby heat the liquid to a predetermined temperature; and dispensing the heated liquid, to thereby produce heated liquid food products.

31. The method of claim 30, the dispensing step further comprising the step of:

mixing the heated liquid with a dried food product.

32. The method of claim 31, the mixing step further comprising the step of:

agitating the dried food product and the heated liquid by an impeller coupled to a motor.

33. The method of claim 30, wherein the liquid is water.

34. A heated liquid food product dispenser comprising:

a first electrode having an electrically conducting surface;

a second electrode having an electrically conducting surface disposed spaced apart from the first electrode;

a heating passage defined by the first and the second electrodes, the heating passage including:

an inlet opening configured to receive liquid into the heating passage;

an electrical power supplier configured to supply an electrical current to the first and the second electrodes, wherein the first and second electrodes arranged to make electrical contacts with liquid received into the heating passage, and the liquid in the heating passage generates heat when an electric current flows through the liquid and between the first and second electrodes;

a current meter coupled to the heating passage and configured to measure the electrical current flowing between the electrodes; and a controller configured to calculate conductivity of the liquid based on the measured electrical current and to adjust the electrical current supplied to the electrodes based on, in part, the calculated conductivity; and a dispensing head configured to receive the heated liquid from the heating passage and arranged to dispense the heated liquid for the production of heated liquid food products.

35. The dispenser of claim 34, which further comprises:

a mixing chamber arranged to form a fluid seal with and to receive liquid from the dispensing head, the mixing chamber configured to produce heated liquid food products.

36. The dispenser of claim 35, which further comprises:

a hopper arranged to hold dried food products.

37. The dispenser of claim 36, which further comprises:

an auger screw configured to dispense a predetermined amount of the dried food products from the hopper to the mixing chamber.

38. The dispenser of claim 36, which further comprises:

an agitator including an impeller coupled to a motor, the agitator configured to create a swirl in the mixing chamber.

39. The dispenser of claim 34, wherein the liquid is water.

* * * * *